US006035620A

United States Patent [19]

Kallmann et al.

[11] Patent Number: 6,035,620

[45] Date of Patent: Mar. 14, 2000

[54] TWISTING SPINDLE, ESPECIALLY TWO-FOR-ONE OR DIRECT CABLING SPINDLE

[75] Inventors: Jürgen Kallmann, Kaarst; Ingo Filz, Viersen, both of Germany

[73] Assignee: Volkman GmbH & Co., Germany

[21] Appl. No.: 09/149,383

[22] Filed: Sep. 8, 1998

[30] Foreign Application Priority Data

Sep. 8, 1997 [DE] Germany ..... 197 39 281
Nov. 3, 1997 [DE] Germany ..... 297 19 456 U

[51] Int. Cl.[7] ..... D01H 1/10

[52] U.S. Cl. ..... 57/58.49; 57/58.32; 57/58.34; 57/58.36; 57/58.38; 57/58.853; 57/354

[58] Field of Search ..... 57/58.49, 58.52, 57/58.7, 58.83, 58.32, 58.34, 58.36, 58.38, 354

[56] References Cited

U.S. PATENT DOCUMENTS

| | | | |
|---|---|---|---|
| 2,127,921 | 8/1938 | Kent | 117/9.5 |
| 2,609,652 | 9/1952 | Halleux | 57/58 |
| 3,007,299 | 11/1961 | Starnes . | |
| 5,515,671 | 5/1996 | Dur | 57/58.83 |
| 5,628,177 | 5/1997 | Ballhausen et al. | 57/58.83 |

FOREIGN PATENT DOCUMENTS

| | | | |
|---|---|---|---|
| 0109573 | 5/1984 | European Pat. Off. . | |
| 1245010 | 10/1967 | France . | |
| 1104653 | 9/1959 | Germany . | |
| 1840338 | 2/1961 | Germany . | |
| 1268031 | 1/1964 | Germany . | |
| 2952283 | 6/1981 | Germany . | |
| 3023074 | 1/1982 | Germany . | |
| 3728213 | 3/1988 | Germany | 57/58.49 |
| 4018541 | 12/1991 | Germany . | |
| 68534 | 7/1951 | Netherlands . | |
| 417418 | 12/1964 | Switzerland . | |

*Primary Examiner*—William Stryjewski
*Attorney, Agent, or Firm*—Robert W. Becker & Associates

[57] ABSTRACT

A twisting spindle has a spindle that is driven in rotation, a protective pot supported on the spindle and secured against rotation, and a rotary disk fixedly connected to the spindle. The rotary disk has a radially extending yarn channel connected to the hollow spindle axle and supports a cylindrical mantle surrounding the protective pot. The cylindrical mantle has above the outlet opening of the yarn channel a yarn guide element. An intermediate housing that is freely rotatable and surrounds the rotary disk and the cylinder mantle is provided. A stationary outer housing receiving the intermediate housing is also provided.

22 Claims, 9 Drawing Sheets

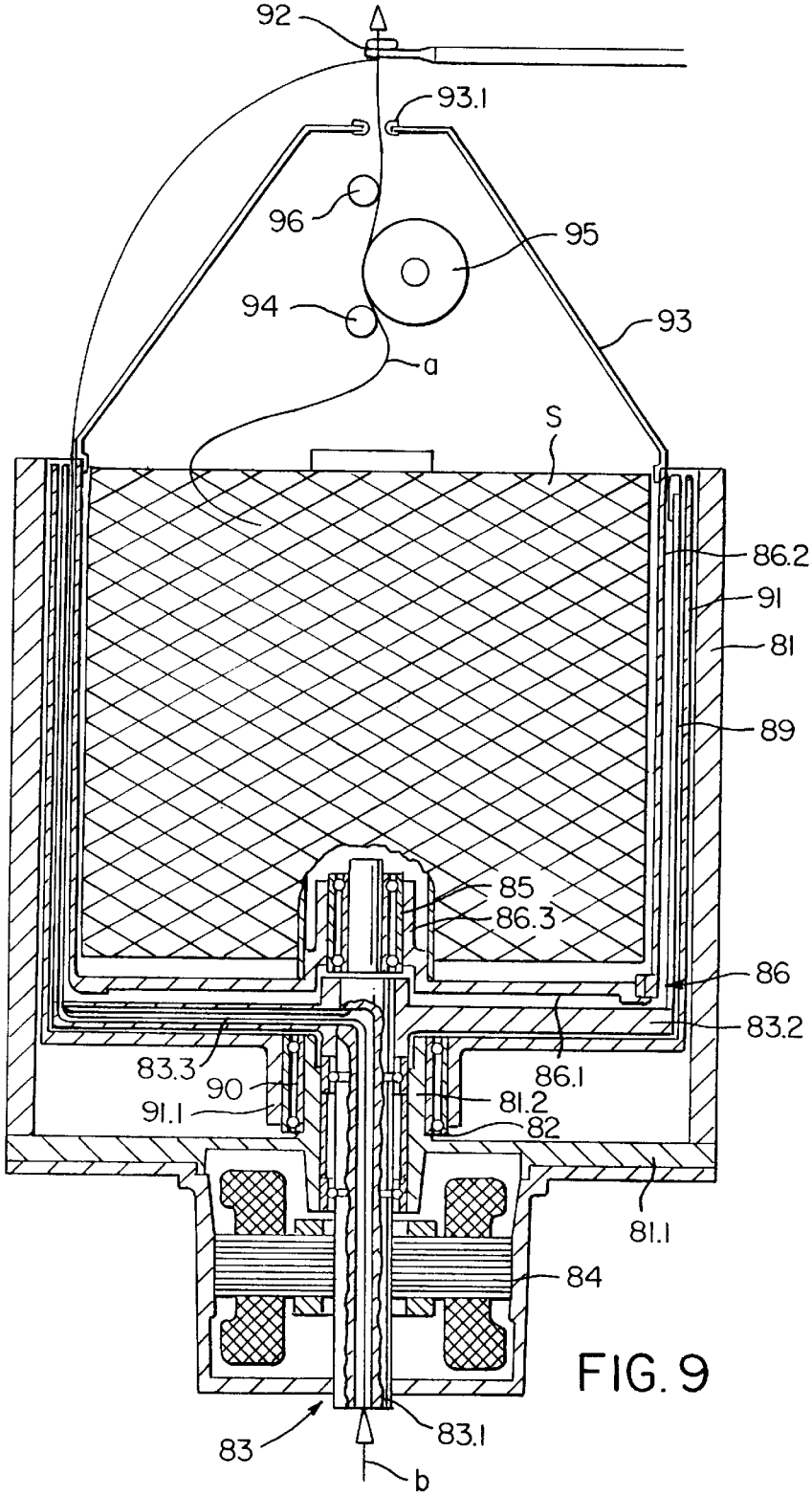
FIG. 9
FIG. 10
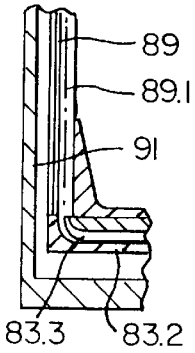

TWISTING SPINDLE, ESPECIALLY TWO-FOR-ONE OR DIRECT CABLING SPINDLE

BACKGROUND OF THE INVENTION

The invention relates to a twisting spindle which is embodied either as a two-for-one twisting spindle or as direct cabling spindle, comprising a spindle that is rotatably driven and a protective pot which is supported on the spindle and secured against rotation. The protective pot is designed to receive for both types of spindles at least one supply bobbin or, in the case of a two-for-one twisting spindle, also at least two open end spinning rotors for producing spun yarns to be introduced into the hollow spindle axle.

In two-for-one twisting spindles the yarn is conventionally removed from the supply bobbin in the upward direction and the yarn then is guided through the hollow spindle axle in the downward direction to the rotating yarn storage disk. The yarn is then guided through the yarn storage disk radially outwardly, surrounds it in a certain area and then, under formation of a yarn balloon, is guided upwardly between the protective pot secured against rotation and the stationary balloon limiter to a yarn guide eye determining the tip of the balloon from where the yarn is then guided to a winding device. The yarn storage disk has the purpose to receive between the exit location of the yarn from the spindle and the yarn balloon a yarn reserve which provides compensation between inner and outer yarn tensioning forces.

In a direct cabling spindle a first yarn is conventionally removed from a supply bobbin introduced into a stationary protective pot and is then guided to a yarn guide eye that is arranged on an extension of the spindle axle. A second yarn is guided through the spindle shaft which is a hollow shaft and is then guided as a yarn balloon about the protective pot and is guided together with the first yarn through the yarn guide eye to a winding device.

In the area of the yarn balloon formed by the second yarn, the air layer that is present between the protective pot and the balloon limiter surrounding the protective pot is penetrated by the balloon yarn and is partially subjected to rotations so that the yarn is subjected to a total of three components, i.e., the centrifugal force acting in the radial direction, the friction acting in a tangential direction and resulting from air friction and friction at the balloon limiter, as well as a yarn tensioning force acting in the axle direction and determined by the geometry of the spindle and the rotary or storage disk. These combined forces can result in intolerable loads on certain yarn types and can thus damage the yarn.

For reducing such yarn stress, different measures have been suggested in regard to two-for-one twisting spindles.

Group I

This group includes two-for-one twisting spindles in which the balloon limiter is rigidly connected to the spindle and thus rotates accordingly at the spindle rpm (see German patent 1 840 338 U1; Netherlands patent 68 584; German published document 29 52 283 A1).

Group II

This group includes two-for-one twisting spindles with either forcibly driven or freely rotating balloon limiter which is entrained by the circulating yarn balloon and the rotating annular air column (Swiss patent 417418; German published document 40 18 541 A1). This group also includes the two-for-one twisting spindle disclosed in German patent 1 268 031 C1 in which a balloon limiter mantle identified as a yarn storage mantle rotating together with the spindle extends only over a portion of the spindle height and has connected thereto in the axle direction a stationary balloon limiter ring. In this embodiment the stationary balloon limiter ring results in a braking action of the yarn balloon portion resting thereat so that in this manner a yarn storage is provided.

Group III

This group includes two-for-one twisting spindles according to U.S. Pat. No. 2,127,921; U.S. Pat. No. 2,609,652; and U.S. Pat. No. 3,007,299 as well as British patent 1 245 010 wherein the radially exiting yarn coming from the rotating spindle center is forcedly guided for reducing the yarn tensioning force through a yarn channel that is coupled to the spindle and rotates therewith. This eliminates a yarn storage, due to the lack of a storage possibility, as well as a substantially free balloon development.

In systems according to the Group I to III the yarn tensioning forces can be considerably reduced but a very high energy consumption results.

Group IV

For reducing the drive output of spindles the German published document 30 23 074 A1 and European published document 0 109 573 A1 discloses spindles with a rotating bobbin pot which is surrounded by a stationary mantle. Details in regard to the spacing between the rotating and the stationary pot are disclosed for the purpose of providing a laminar flow.

Group V

In a spinning pot disclosed in German patent 1 104 653 an intermediate housing is arranged between the stationary spinning chamber and the spinning pot, wherein the intermediate housing encloses completely or partially the pot, whereby the intermediate housing is rotatably supported in the spinning chamber or at the drive motor of the pot and is entrained by the entraining action of the air column rotating with the spinning pot at a rpm which is smaller than that of the spinning pot. Due to the reduced relative velocity between the spinning pot and the circulating intermediate housing on the one hand, and between the circulating intermediate housing and the stationary spinning chamber, on the other hand, the driving action of the spinning pot thus requires only a correspondingly reduced output. However, a protection of the spun yarn is neither considered nor achievable.

All measures of Groups I through V present individual steps which relate only partially, in regard to two-for-one twisting spindles and comparable direct cabling processes, the reduction of the yarn tensioning force, the reduction of energy consumption as well as increase of productivity. The disclosed solutions relate only to partial objects and in themselves therefore can not improve the two-for-one twisting process or the direct cabling process with regard to technological or economical or production-related considerations.

The invention has the object to provide a two-for-one twisting spindle or a direct cabling spindle embodiment of a twisting spindle such that the forces acting on the yarn are reduced, that the drive output required for driving the spindle is as minimal as possible and that the productivity is increased.

SUMMARY OF THE INVENTION

For solving this object for a two-for-one twisting spindle a twisting spindle is provided having an outer stationary housing; a spindle having a hollow spindle axle and rotatably mounted in the outer stationary housing, an inner housing rotatably supported inside the outer stationary housing, and a protective pot supported on the spindle and secured against rotation. A rotary disc is fixedly connected to the spindle. The rotary disc has a radially extending yarn channel connected to the hollow spindle axle. The yarn channel has an outlet opening. A cylindrical mantle is mounted on the rotary disc and surrounds the protective pot. The cylindrical mantle comprises at least one yarn guide element positioned above the outlet opening. The inner housing encloses the rotary disc and the cylindrical mantle.

For solving this above object for a direct cabling spindle a twisting spindle is provided having an outer stationary housing, a spindle having a hollow spindle shaft and rotatably mounted in the outer stationary housing, an inner housing rotatably supported inside the outer stationary housing, and a protective pot supported on the spindle and secured against rotation. A rotary disc is fixedly connected to the spindle. The rotary disc has a radially extending yarn channel connected to the hollow spindle shaft. The yarn channel has an outlet opening. A cylindrical mantle is mounted on the rotary disc and surrounds the protective pot. The cylindrical mantle comprises at least one yarn guide element positioned above the outlet opening. The inner housing encloses the rotary disc and the cylindrical mantle.

Due to the forced guiding of the yarn rotating with the spindle rpm (revolution per minute) about the protective pot within the yarn guide element of the cylindrical mantle surrounding the protective pot, the tensioning forces acting on the yarn are minimal while the drive output for the spindle due to the presence of the intermediate freely rotatable housing positioned between the cylinder mantle and the stationary outer housing, is reduced.

The invention relates also to an optimization, with regard to constructive aspects as well as with regard to the reduction of the energy consumption, in the area of the bearing system of the individual spindle elements rotating relative to one another.

BRIEF DESCRIPTION OF THE DRAWINGS

The invention will be disclosed in detail with the aid of the drawings.

FIG. 9 shows in axial section a twisting spindle embodied as a direct cabling spindle;

FIG. 10 shows in an enlarged representation a detail of FIG. 9.

DESCRIPTION OF PREFERRED EMBODIMENTS

Figure 1:
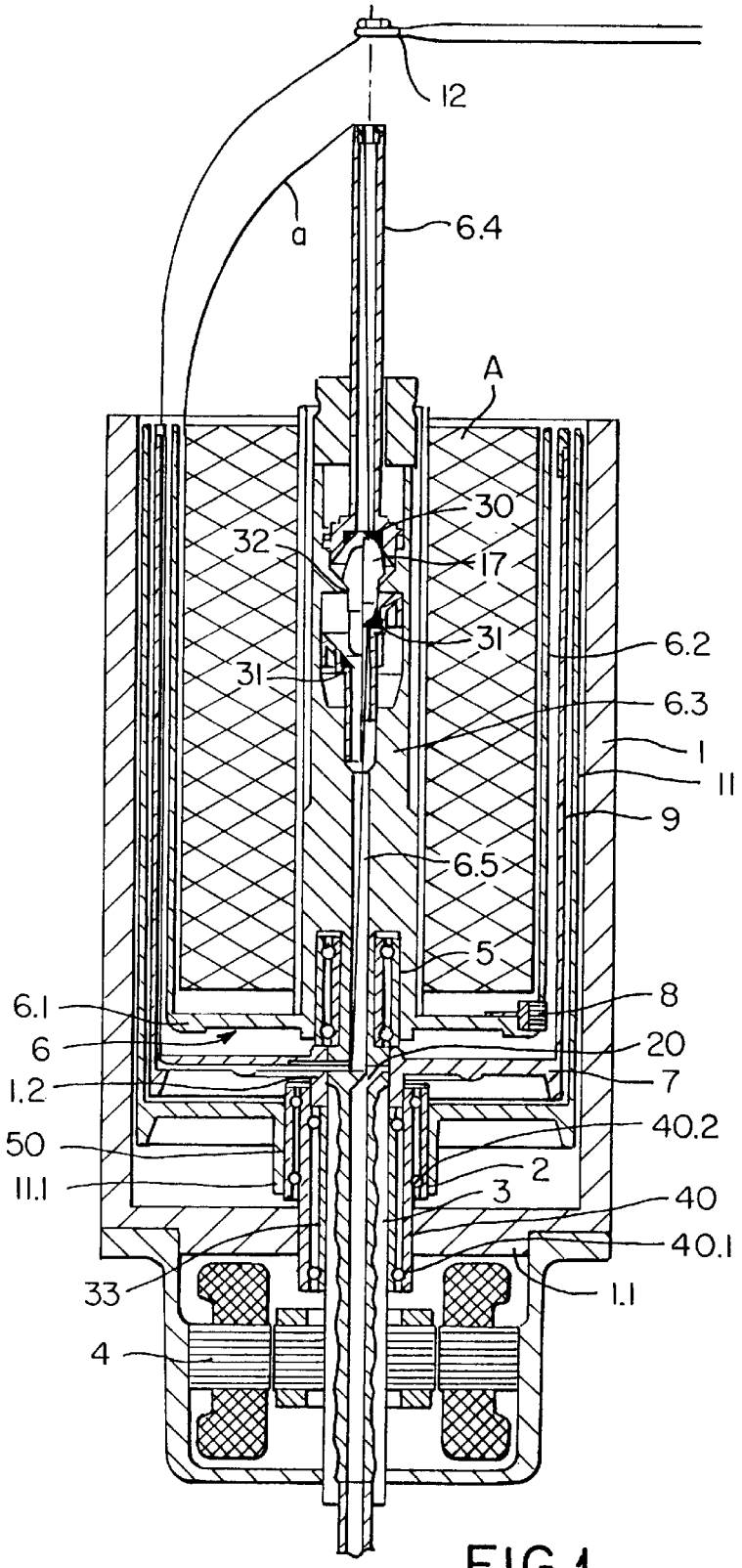
FIG. 1 shows an axial section of a first type of the inventive two-for-one twisting spindle.
Figure 2:
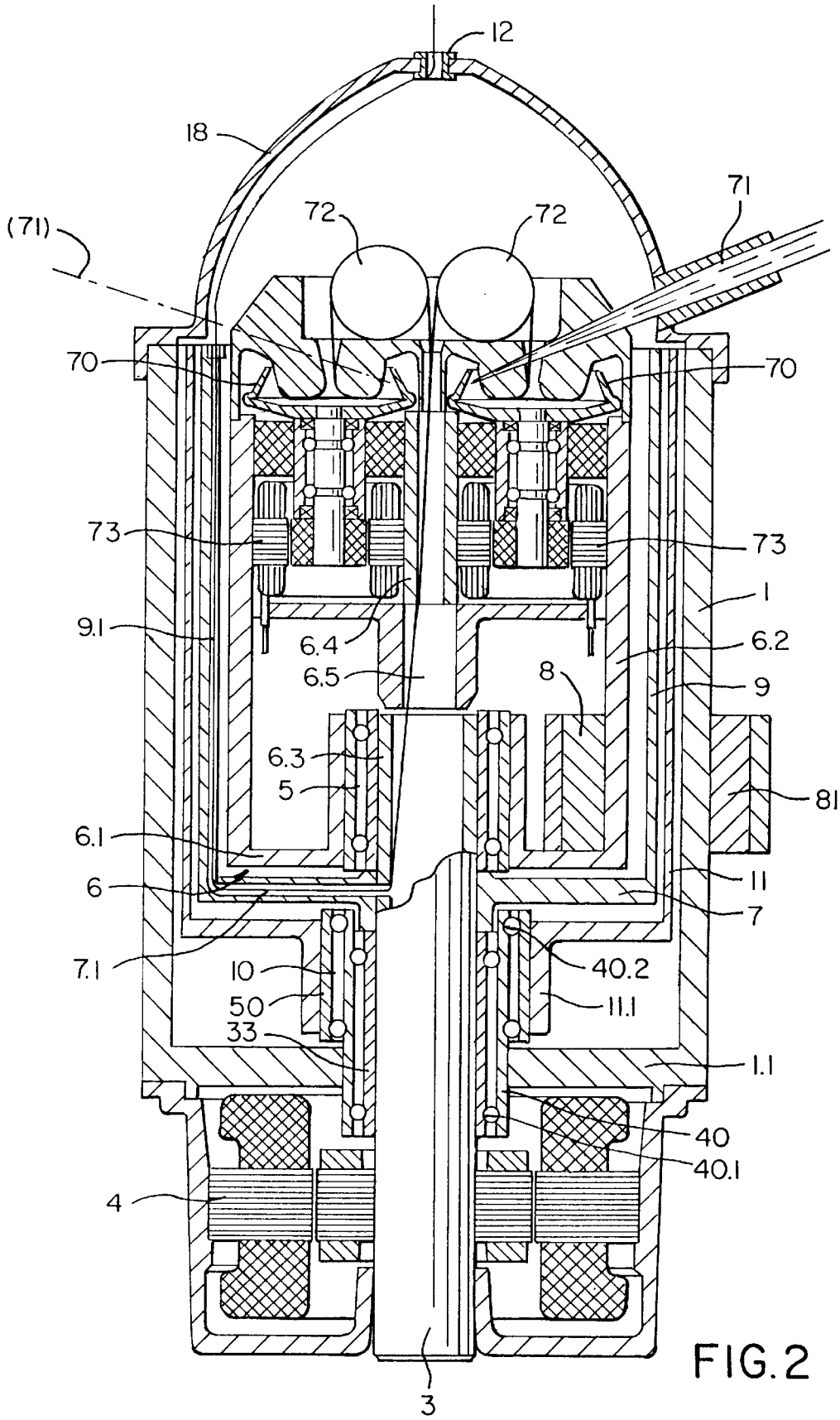
FIG. 2 shows an axial section of a second type of the inventive two-for-one twisting spindle.

In FIGS. 1 and 2 the same or comparable elements with regard to construction or function have the same reference numerals.

The two-for-one twisting spindle represented in FIG. 1 comprises a cylindrical outer housing 1 stationarily supported in a non-represented spindle bank, having a bottom 1.1 with a bearing hub 40 that provides a bearing sleeve. The inner mantle surface of this bearing hub 40 comprises a bearing race 40.1 and thus forms an integrated outer ring support for the spindle shaft 3 on which a bearing bushing 33 is positioned.

The bearing hub 40 in its upper area is provided with a bearing race 40.2 at its outer side and thus forms an integrated inner ring support for the intermediate housing 11 that forms the energy saving pot and has a bearing hub 11.1 that is freely rotatably supported within the intermediate sleeve 40 by interposition of an outer bearing ring 50.

The drive of the spindle shaft 3, for example, embodied as a hollow spindle, is provided by the individual motor drive 4 which is not part of this invention.

At the upper end of the spindle 3 a protective pot 6 is supported by a bearing 5 which comprises a protective pot mantle 6.2, a protective pot bottom 6.1, and a protective pot hub 6.3. Connected thereto is a hollow spindle axle 6.5 and a yarn inlet tube 6.4. The hollow spindle axle 6.5 is only schematically represented. It is provided with a non-inventive ventable yarn brake 17 according to German patent 29 14 656 C2. In order to prevent the protective pot 6 from rotating, it is provided with securing magnets 8B as shown, which have positioned opposite therefrom the conventional counter magnets 81 represented in FIG. 2, or, as an alternative, when the spindle arrangement is slanted, securing against rotation is performed by weight stabilization.

In the first twisting spindle type according to FIG. 1 the protective pot 6 is a conventional bobbin support for receiving at least one supply bobbin A.

In the second two-for-one twisting spindle type according to FIG. 2 for performing a so-called integrated spinning-twisting method, as disclosed in German patent 44 27 875 C1, the protective pot 6 receives at least two neighboring spinning devices, preferably in the form of open end spinning rotors 70, 70, to which dissolved fiber material is supplied via the supply channels 71. The spun yarns produced by the spinning rotors are removed by rollers 72, 72 through the yarn inlet tube 6.4 into the hollow spindle axle 6.5 in order to be twisted by the two-for-one twisting process. The rotational drive of the open end spinning rotor 70,70 which are supported in the protective pot 6 and are not part of this invention is provided by electric motors 73, 73.

Figure 3:
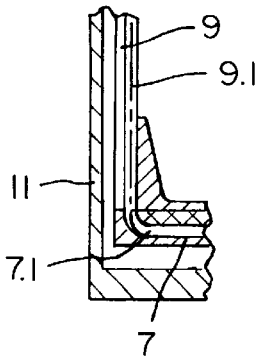
FIG. 3 shows in an enlarged representation a detail of FIG. 1.

A rotary disk 7 is positioned on the spindle 3 and rotates with the spindle. The rotary disk 7 is provided with a radially extending yarn channel 7.1 that is connected to the axial bore of the protective pot hub 6.3 and, for the twisting spindle type according to FIG. 1, also to the axial bore of the spindle. The outer edge of the rotary disk 7 has positioned thereon a cylindrical mantle 9 which over its entire height, or over a portion of its height, is provided with a yarn guide element, especially a yarn guide channel 9.1 having a lower end connected to the yarn channel 7.1, see FIG. 3.

Figure 3A:
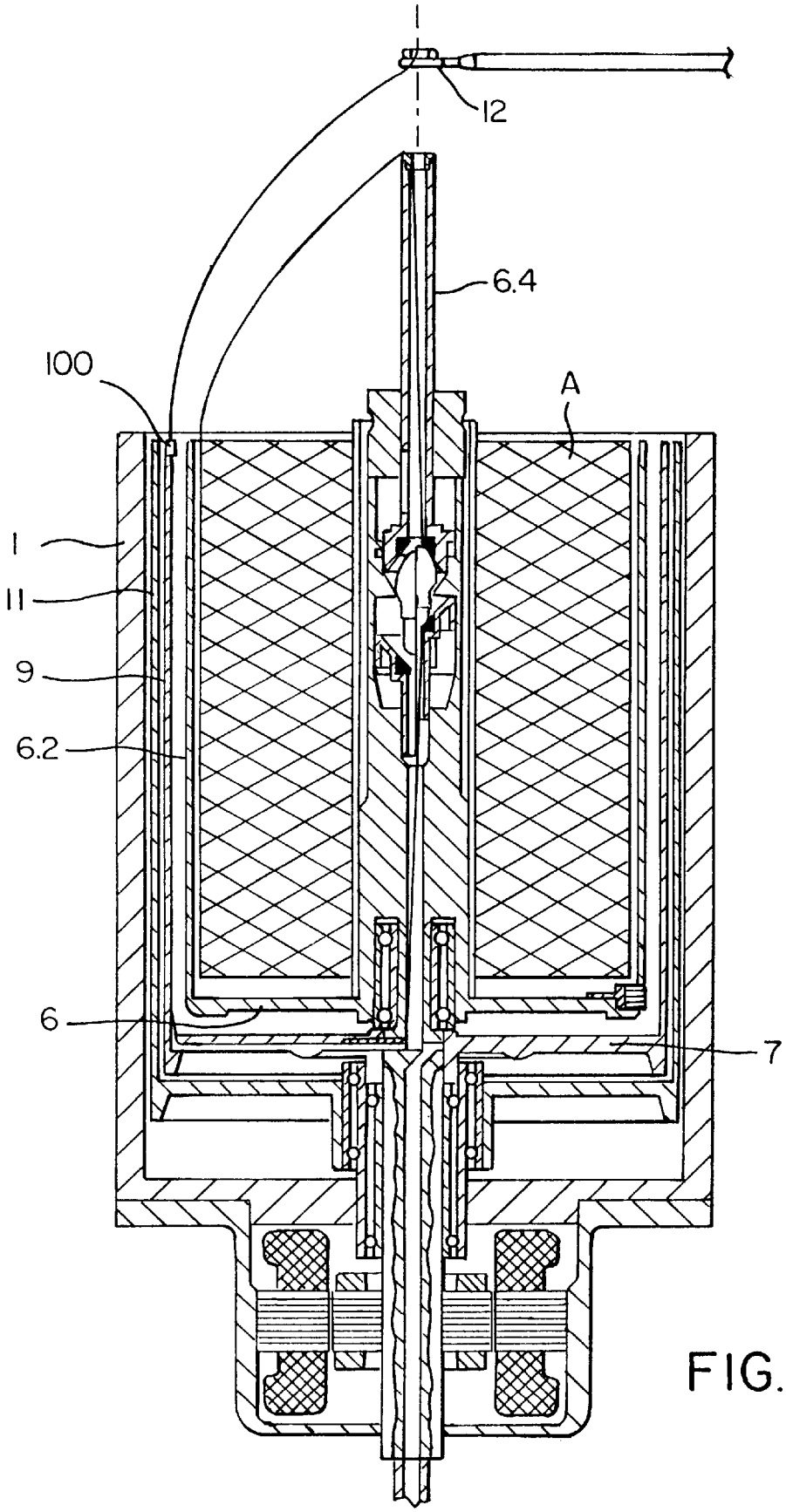
FIG. 3*a* shows a preferred arrangement of the yarn guide element.

According to FIG. 3*a*, as an alternative, above the yarn outlet opening of the yarn channel 7.1 at least one eye-shaped yarn guide element 100 is arranged.

In operation of the two-for-one twisting spindle represented in FIG. 1, the yarn a removed from the supply bobbin A is guided in the axial direction within the yarn guide inlet tube 6.4, the hollow spindle axle, and the axial bore 6.5 of the protective pot hub 6.3 before it is guided through the especially radially extending yarn channel 7.1 into the eye-shaped yarn guide element 100 or the yarn guide channel 9.1 of the cylindrical mantle 9 rotating with the spindle. The yarn exiting from the upper end of the cylindrical mantle 9 is guided subsequently according to FIG. 1, optionally by balloon formation, in a conventional manner to the yarn guide eye 12 positioned on an extension of the spindle axle and is then supplied in a conventional manner to a non-represented winding device.

According to FIG. 2, the yarn exiting from the yarn guide channel 9.1 can also be guided along the path to the yarn guide eye 12' when a hood 18 etc. is positioned on the outer housing 1.

In the embodiment according to FIG. 2 the spun yarns produced by the open end spinning rotors follow the same path, as disclosed in connection with FIG. 1 for the yarn a.

In the embodiment according to FIG. 1 in the area of the transition between the hollow spindle axle and the radially extending yarn channel 7.1 an injector arrangement 20 is provided which is only schematically represented and does not constitute part of the invention. For threading the yarn this injection arrangement 20 is supplied with compressed air through the hollow spindle 3 so that a yarn held at the upper end of the yarn inlet tube 6.4 is sucked by the suction action and blown through the radial yarn channel 7.1 and the subsequently arranged yarn guide channel 9.1. The capsule yarn brake 17, arranged within the area of the hollow spindle axle, is moved as disclosed in German patent 29 14 656 C2, from the braking position represented in the right portion of FIG. 1 in which the capsule brake 17 rests at the upper and lower braking surface rings 30, 31 and is released from this braking position because the lower braking surface ring 31 (represented to the left of FIG. 1) is moved under the vacuum produced within the hollow spindle axle in the downward direction so that the capsule yarn brake 17 is moved by gravity in the downward direction and is secured at a support cam 32 in a position in which the hollow spindle axle is open.

Figure 4:
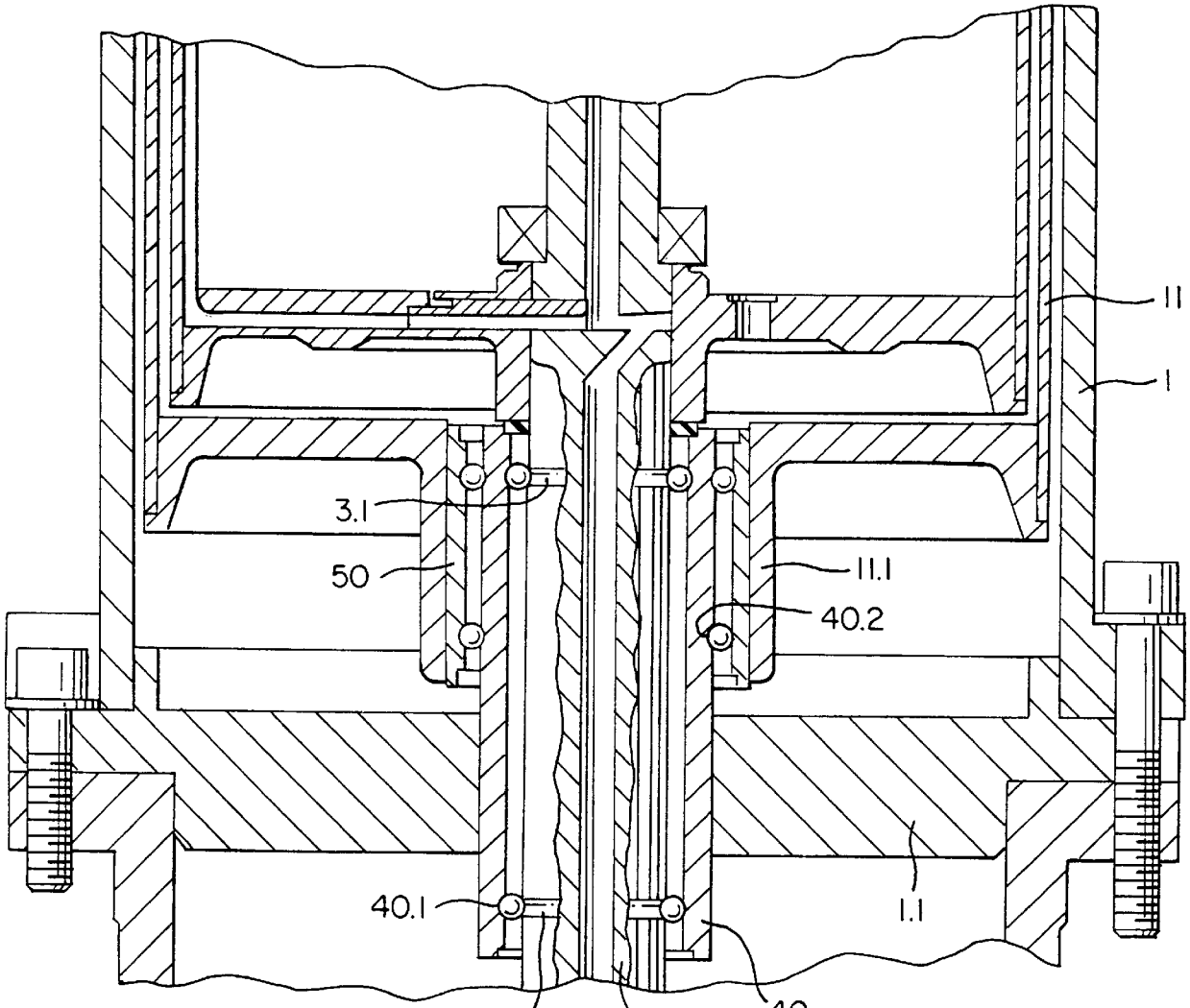
FIGS. 4–8 show in an enlarged representation in axial section further developments of the invention in the area of the spindle support.

The embodiment of the bearing system according to FIG. 4 differs from the embodiment according to FIG. 1 in that the spindle 3 is provided with a bearing race 3.1 forming an integrated inner ring support. The bearing race 3.1 is machined into the spindle 3.

While in the bearing systems according to FIGS. 1, 2 and 4 the spindle 3 as well as the inner housing 11 forming the energy saving pot can rotate relative to a stationary bearing hub 40, in the bearing systems represented in FIGS. 5 through 8 only one of the two rotating elements, spindle or inner housing, is directly supported in a rotating manner relative to the stationary part while the other rotating part is rotatably supported at a rotating part. This can further reduce the energy consumption for operating the spindle.

Figure 5:
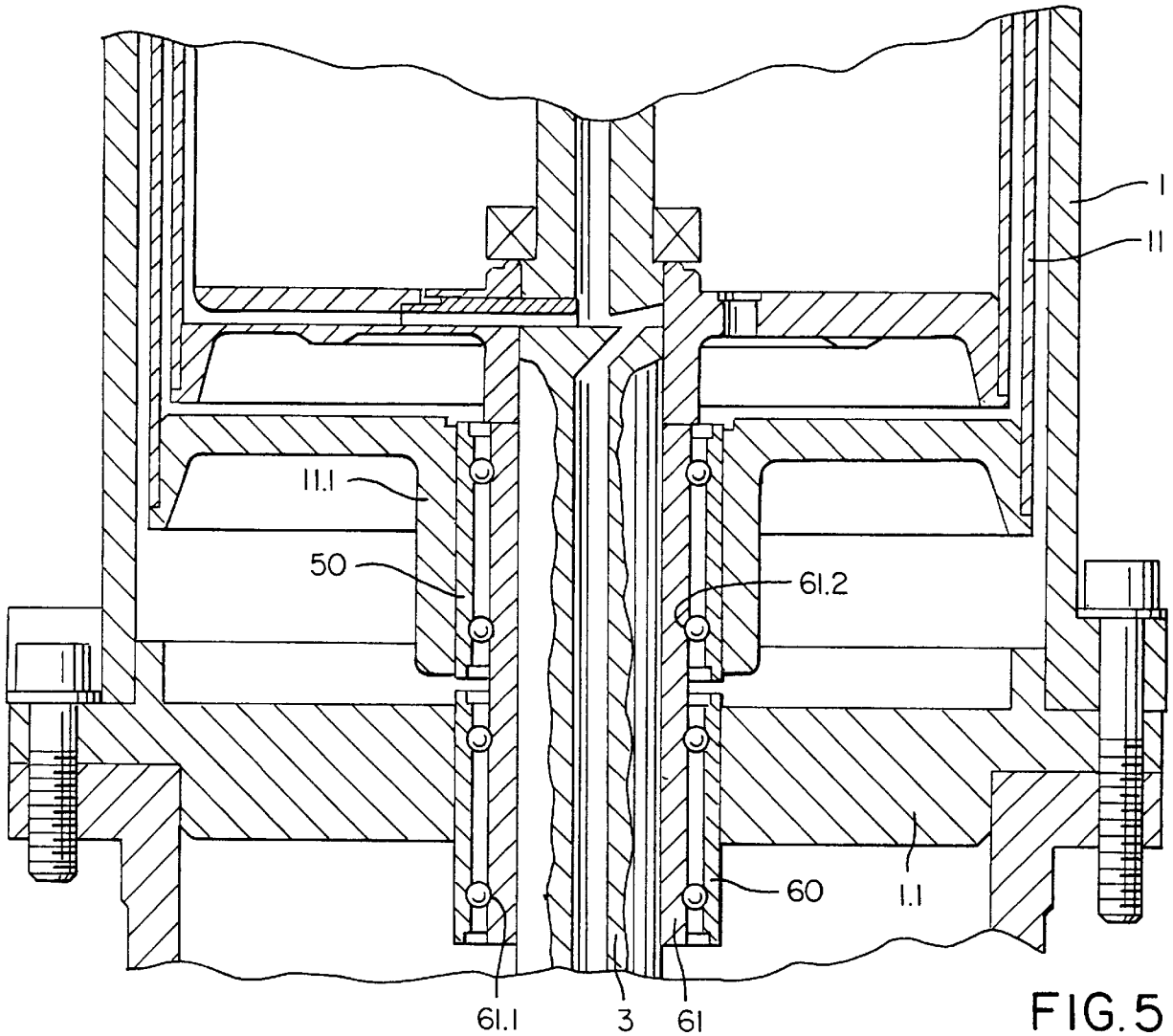

In the embodiment according to FIG. 5 the outer housing 1 has a bottom 1.1 in which an outer bearing ring 60 is provided for supporting a bearing bushing 61 positioned on the spindle 3. The bearing bushing 61 is provided at its lower end at its outer mantle surface with a bearing race 61.1 positioned opposite the outer bearing ring 60 and thus provides an integrated inner ring support for the spindle shaft 3. The bearing bushing 61 at its upper end is provided on its outer mantle surface with a machined bearing race 61.2 and thus forms an integrated inner ring bearing for the inner housing 11 having a bearing hub 11.1 with an outer bearing ring 50.

Figure 6:
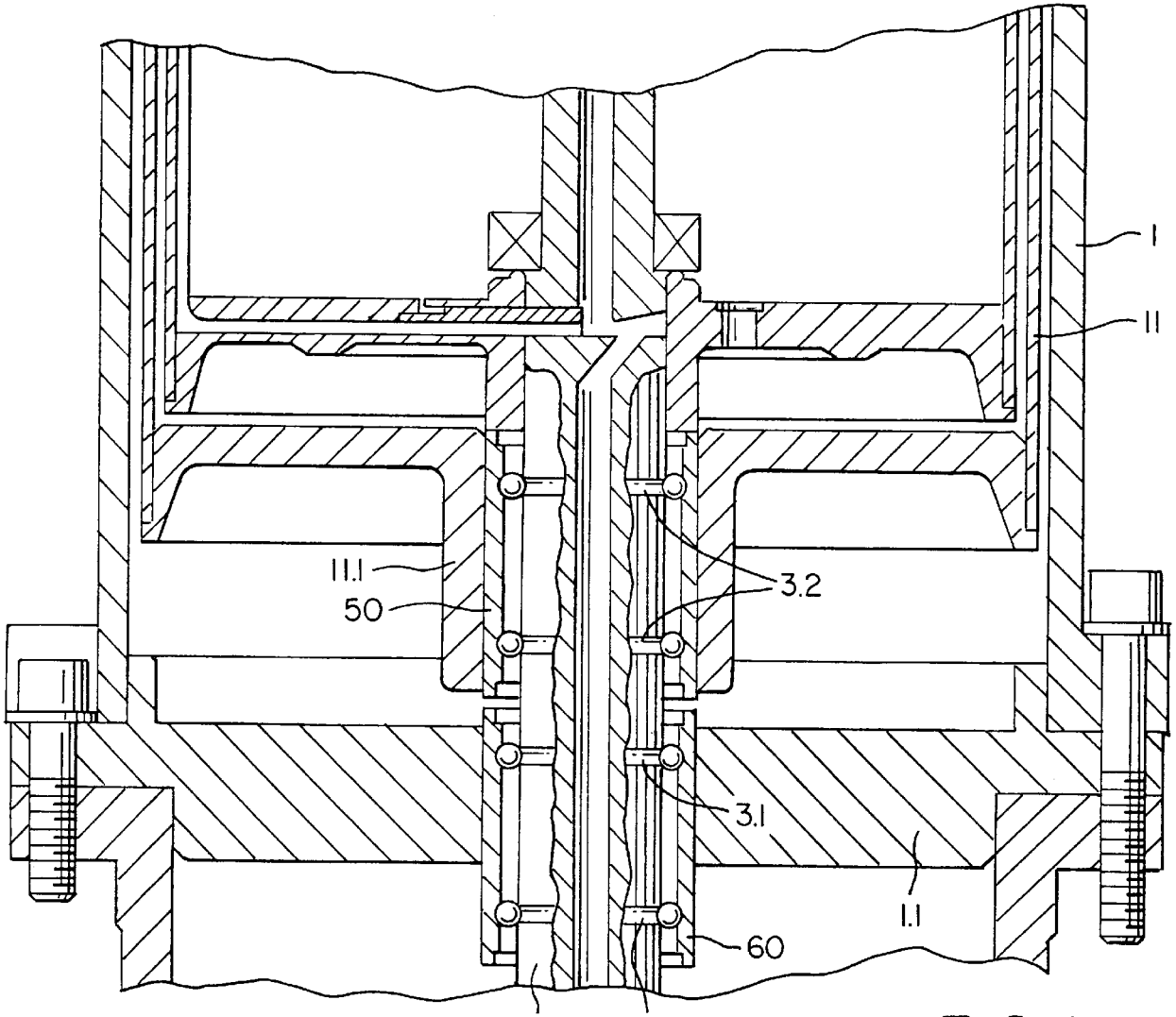

The embodiment according to FIG. 6 differs from the embodiment according to FIG. 5 in that the bearing bushing 61 is eliminated whereby the spindle shaft 3 is provided in the lower portion positioned opposite the outer bearing ring 60 as well as in the upper portion positioned opposite the outer bearing ring 50 with machined bearing races 3.1, respectively, 3.2 which form integrated inner ring supports for the spindle shaft 3 itself, on the one hand, and for the intermediate housing 11, on the other hand.

In the embodiment according to FIG. 5 and FIG. 6 the energy saving pot is driven, in addition to being driven by the ventilation friction in the gap between the spindle 3 and the saving pot 11, also by the bearing friction of the bearing 50. This reduces the relative velocity between the spindle and the saving pot which results in a considerable improved effectiveness of the energy saving pot.

Figure 7:
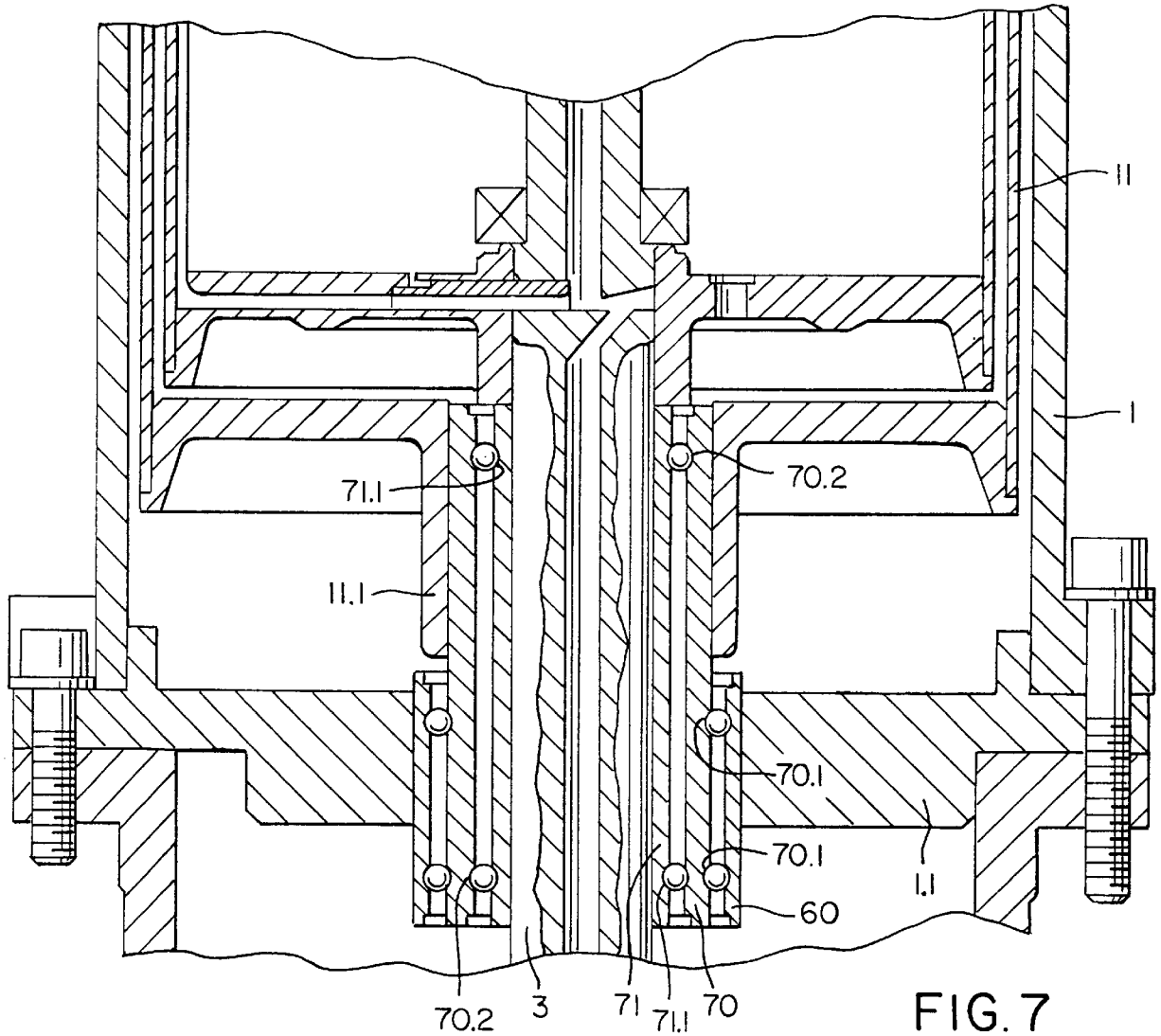

In the embodiment according to FIG. 7, the bottom 1.1 of the outer housing 1 has inserted therein an outer bearing ring 60 for supporting an intermediate sleeve 70 which in the lower portion is provided with a machined bearing race 70.1, opposite the outer bearing ring 60, for providing an inner ring support. On the upper end of the intermediate sleeve 70 the intermediate housing 11 with its bearing hub 11.1 is positioned which provides the energy saving pot. The inner side of the intermediate sleeve 70 is provided for formation of an integrated outer bearing with a machined bearing race 70.2. A bearing bushing 71 is positioned on the spindle shaft 3 which is provided at its outer mantle surface with a machined bearing race 71.1 forming an integrated inner ring support.

Figure 8:
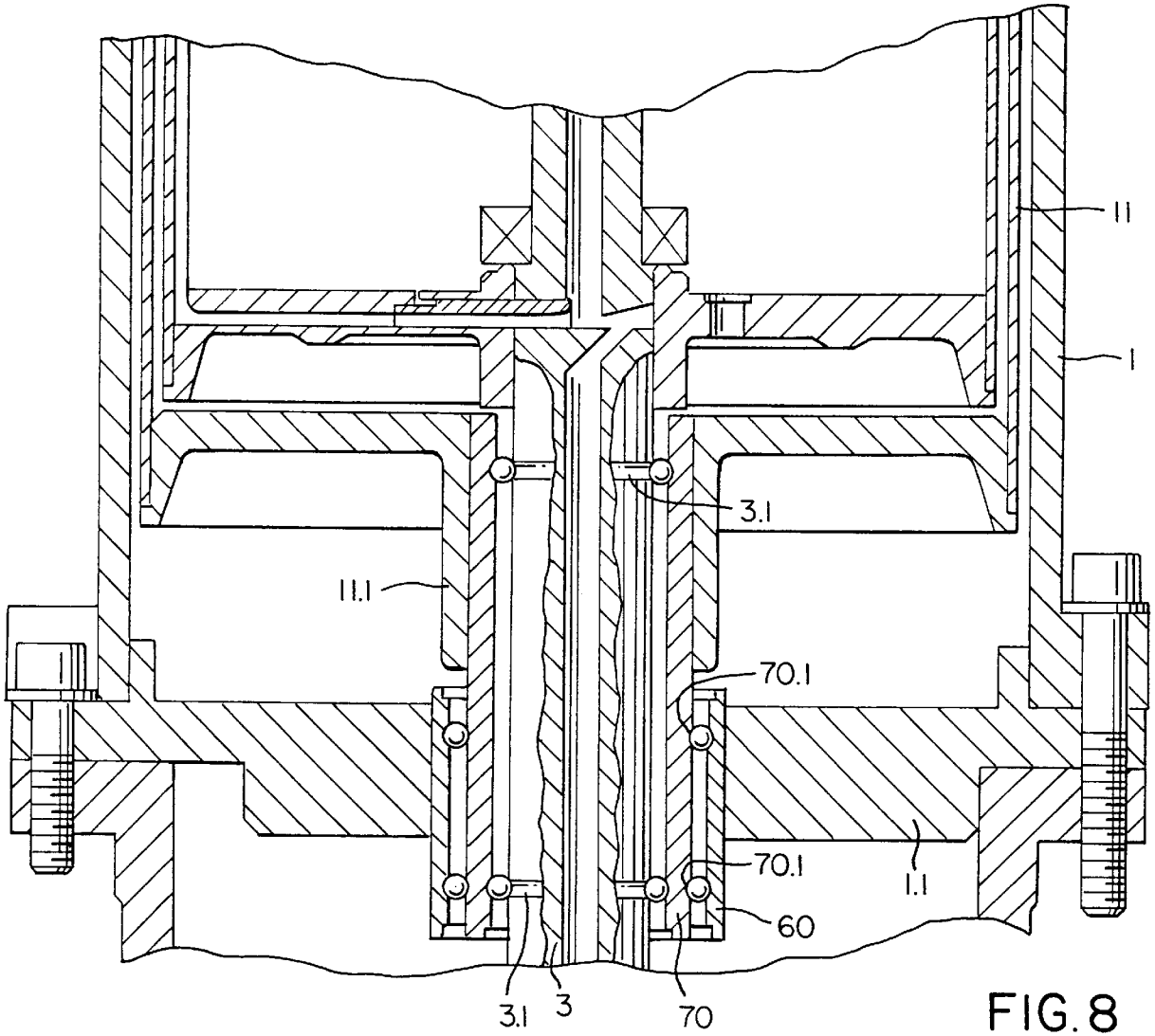

The embodiment according to FIG. 8 differs from the embodiment according to FIG. 7 by elimination of the bearing bushing 71 in that the spindle shaft 3 is provided, in analogy to FIG. 4, with machined bearing races 3.1.

In the embodiments according to FIGS. 7 and 8 the energy saving pot is driven in addition to the ventilation friction within the gap between the spindle 3 and the energy saving pot 11 also by the bearing friction of the bearing 70. Even though the bearing friction of the bearing 60 brakes the energy saving pot, this solution also reduces the relative velocity between the spindle and the energy saving pot so that the effectiveness of the energy saving pot is improved.

The direct cabling spindle according to FIG. 9 comprises a cylindrical outer housing 81 with bottom 81.1 and bearing hub 81.2 stationarily supported in a non-represented spindle bank. Within the bearing hub 81.2 a spindle 83 is supported by a bearing 82 which is driven by an individual motor drive 84 in a rotating manner, whereby this aspect is not part of the invention.

The spindle 83 has a hollow spindle shaft 83.1 and a rotary disk 83.2 fixedly connected thereto which comprises a radially extending yarn channel 83.3 connected to the hollow spindle shaft 83.1. A cylindrical mantle 89 is positioned on the outer edge of the rotary disk 83.2 which, as represented, is provided over its entire height or only over a portion thereof with a yarn guide element, especially a yarn guide channel 89.1 having a lower end that is connected to the yarn channel 83.3.

It is also possible to position above the outlet opening of the yarn channel 83.3 instead of the yarn guide channel 89.1 at least one eye-shaped yarn guide element according to FIG. 3*a*.

An inner housing that provides an energy saving pot 91 is freely rotatably supported by interposition of a bearing 90 with a hub 91.1 on the outer side of the bearing hub 81.2.

At the upper end of the spindle 83 a protective pot 86 is supported by a bearing 85 which comprises a protective pot mantle 86.2, a protective pot bottom 86.1, and a protective pot hub 86.3. In order to secure the protective pot 86 against rotation, it is provided in a non-represented manner with securing magnets having positioned opposite therefrom conventional counter magnets.

The protective pot 86 serves as a conventional bobbin support for receiving a supply bobbin S. A hood 93 for supporting guide rollers 94, 96 is positioned at the upper end of the protective pot 86 and has a central opening 93.1. A yarn brake 95 is positioned therein and is provided for braking the upwardly removed yarn a.

When operating the direct cabling spindle, the yarn a is removed from the supply bobbin S in the upward direction through the opening 93.1 of the hood while, on the other hand, a yarn b removed from a non-represented supply bobbin is guided through the hollow spindle shaft 83.1, the yarn channel 83.3, and the yarn guide element 89.1 of the cylinder mantle 89 rotating with the spindle 83, and is then introduced together with the yarn a in a conventional manner into the yarn guide eye 92 positioned on the extension of the spindle axle and, subsequently, in a conventional manner is supplied to a non-represented winding device.

Upon axial removal, the two yarns a and b will twist about one another without the yarns being subjected to their own twist. Thus, one spindle rotation results in one cabling rotation.

The specification incorporates by reference the disclosure of German Priority documents 197 39 281.4 of Aug. 29 1997 and 297 19 456.9 of Nov. 3 1997.

The present invention is, of course, in no way restricted to the specific disclosure of the specification and drawings, but also encompasses any modifications within the scope of the appended claims.

What is claimed is:

1. A twisting spindle comprising:

an outer stationary housing (1);

a spindle (3) having a hollow spindle axle (6.3);

said spindle (3) rotatably mounted in said outer stationary housing (1);

an inner housing (11) rotatably supported inside said outer stationary housing (1);

a protective pot (6) supported on said spindle (3) and secured against rotation;

a rotary disc (7) fixedly connected to said spindle (3);

said rotary disc (7) having a radially extending yarn channel (7.1) connected to said hollow spindle axle (6.3);

said yarn channel (7.1) having an outlet opening;

a cylindrical mantle (9) mounted on said rotary disc (7) and surrounding said protective pot (6);

said cylindrical mantle (9) comprising at least one yarn guide element (9.1) positioned above said outlet opening;

said inner housing (11) enclosing said rotary disc (7) and said cylindrical mantle (9).

2. A twisting spindle according to claim 1, wherein said yarn guide element (9.1) is connected to said outlet opening of said yarn channel (7.1).

3. A twisting spindle according to claim 2, wherein said yarn guide element (9.1) extends over the entire height of said cylindrical mantle (9).

4. A twisting spindle according to claim 2, wherein said yarn guide element is a yarn guide channel (9.1).

5. A twisting spindle according to claim 1, wherein said protective pot (6) is embodied as a bobbin support for receiving at least one supply bobbin.

6. A twisting spindle according to claim 1, embodied as a two-for-one twisting spindle, comprising at least two open end twisting rotors (70, 70) for producing spun yarns to be introduced into said hollow spindle axle (6.3).

7. A twisting spindle according to claim 1, embodied as a two-for-one twisting spindle, comprising a stationary hub (40) having an outer surface, wherein said shaft (3) is received inside said hub (40) and wherein said inner housing (11) is supported on an outer surface of said hub (40).

8. A twisting spindle according to claim 7, wherein:

said outer stationary housing (1) has a bottom (1.1) having an opening;

said hub (40) is a bearing sleeve mounted in said opening;

said inner housing (11) has a hub portion (11.1) having an outer bearing ring (50) surrounding said hub (40)

said bearing sleeve has an inner mantle surface having an integrated inner race (40.1) forming an integrated outer ring support for said spindle (3);

said bearing sleeve has an outer mantle surface having an integrated outer race (40.2) forming an integrated inner ring support for said hub portion (11.1) of said inner housing (11).

9. A twisting spindle according to claim 8, wherein said spindle (3) has an outer mantle surface, wherein said outer mantle surface has an integrated race (3.1) forming an integrated inner ring support for said spindle (3).

10. A twisting spindle according to claim 7, comprising a bearing bushing (33, 71) mounted on said spindle (3), said bearing bushing (33, 71) having an outer mantle surface and said outer mantle surface having integrated outer race (71.1).

11. A twisting spindle according to claim 1, embodied as two-for-one twisting spindle, comprising a stationary outer bearing ring (60), wherein said spindle (3) is rotatably supported in said outer bearing ring (60), wherein said inner housing (11) is rotatably supported on said spindle (3).

12. A twisting spindle according to claim 11, wherein said spindle (3) has an outer mantle surface having integrated outer races (3.1, 3.2) forming inner ring supports for said shaft (3).

13. A twisting spindle according to claim 11, comprising a bearing bushing (61, 71) positioned on said shaft (3), wherein said bearing bushing (61, 71) has an outer mantle surface having integrated outer races (61.1, 61.2) forming inner ring supports for said shaft (3).

14. A twisting spindle according to claim 1, embodied as two-for-one twisting spindle, comprising a stationary outer bearing ring (60) and an intermediate sleeve (70), wherein said inner housing (11) is rotatably supported by said intermediate sleeve (70) in said outer bearing ring (60), and wherein said spindle (3) is rotatably supported in said intermediate sleeve (70).

15. A twisting spindle according to claim 14, wherein said spindle (3) has an outer mantle surface having an integrated outer race (3.1) forming an integrated inner ring bearing for said shaft (3).

16. A twisting spindle according to claim 14, comprising a bearing bushing (71) positioned on said spindle (3), said bearing bushing (71) provided with an outer mantle surface having an integrated outer race (71.1) forming an integrated inner ring support for said shaft (3).

17. A twisting spindle according to claim 14, wherein said intermediate sleeve (70) has an upper and a lower end, wherein said intermediate sleeve (7) has a inner mantle surface provided at said upper end with an integrated inner race (70.2) forming an outer ring support and has an outer mantle surface provided at said lower end with an integrated outer race (70.2) forming an inner ring support.

18. A twisting spindle comprising:

an outer stationary housing (81);

a spindle (83) having a hollow spindle shaft (83.1);

said spindle (83) rotatably mounted in said outer stationary housing (81);

an inner housing (91) rotatably supported inside said outer stationary housing (81);

a protective pot (86) supported on said spindle (3) and secured against rotation;

a rotary disc (83.2) fixedly connected to said spindle (83);

said rotary disc (83.2) having a radially extending yarn channel (83.3) connected to said hollow spindle shaft (83.1);

said yarn channel (83.3) having an outlet opening;

a cylindrical mantle (89) mounted on said rotary disc (83.2) and surrounding said protective pot (86);

said cylindrical mantle (89) comprising at least one yarn guide element (89.1) positioned above said outlet opening;

said inner housing (91) enclosing said rotary disc (83.2) and said cylindrical mantle (89).

19. A twisting spindle according to claim 18, wherein said yarn guide element (89.1) is connected to said outlet opening of said yarn channel (83.3).

20. A twisting spindle according to claim 19, wherein said yarn guide element (89.1) extends over the entire height of said cylindrical mantle (89).

21. A twisting spindle according to claim 19, wherein said yarn guide element is a yarn guide channel (89.1).

22. A twisting spindle according to claim 18, wherein said protective pot (86.2) is embodied as a bobbin support for receiving at least one supply bobbin.

* * * * *